US009153399B2

(12) United States Patent
Afshari et al.

(10) Patent No.: US 9,153,399 B2
(45) Date of Patent: Oct. 6, 2015

(54) ARC BAFFLING DEVICE

(71) Applicant: EATON CORPORATION, Cleveland, OH (US)

(72) Inventors: Farhad Afshari, Sewickley, PA (US); James Alan Trax, Oakdale, PA (US); Jason Eric Basta, Oakdale, PA (US); Doel Collazo, McDonald, PA (US); Anthony John Fishovitz, Freedom, PA (US); Raymond Peter Gundy, II, Indiana, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/081,042

(22) Filed: Nov. 15, 2013

(65) Prior Publication Data

US 2015/0136740 A1 May 21, 2015

(51) Int. Cl.

*H01H 33/08* (2006.01)
*H01H 9/34* (2006.01)
*H01H 73/18* (2006.01)

(52) U.S. Cl.

CPC ..... *H01H 33/08* (2013.01); *H01H 9/342* (2013.01); *H01H 9/345* (2013.01); *H01H 73/18* (2013.01); *H01H 2009/347* (2013.01)

(58) Field of Classification Search

CPC ..... H01H 33/00; H01H 33/08; H01H 9/34; H01H 9/342; H01H 9/345
USPC ..... 218/34, 149, 157; 335/201
See application file for complete search history.

(56) References Cited

U.S. PATENT DOCUMENTS

| | | | |
|---|---|---|---|
| 5,861,596 | A | 1/1999 | Grass et al. |
| 6,218,636 | B1 | 4/2001 | Blancfene et al. |
| 6,297,465 | B1 | 10/2001 | Groves et al. |
| 6,703,576 | B1 | 3/2004 | Chou et al. |
| 6,977,354 | B1 | 12/2005 | Shea et al. |
| 7,034,242 | B1 | 4/2006 | Shea et al. |
| 7,521,645 | B2 | 4/2009 | Shea et al. |

(Continued)

FOREIGN PATENT DOCUMENTS

| | | | |
|---|---|---|---|
| DE | 102 39 060 | A1 | 4/2003 |
| EP | 2 110 831 | A2 | 10/2009 |

OTHER PUBLICATIONS

European Patent Office, "International Search Report and Written Opinion", Jan. 9, 2015, 12 pp.

*Primary Examiner* — Amy Cohen Johnson
*Assistant Examiner* — Marina Fishman
(74) *Attorney, Agent, or Firm* — Eckert Seamans Cherin & Mellott, LLC; Stephen A. Bucchianeri

(57) ABSTRACT

An arc baffle includes a first baffle member having a number of first venting holes disposed therein, each being structured to receive ionized gases produced by an arcing event; a second baffle member having a number of second venting holes disposed therein; a section of porous material disposed between the first baffle member and the second baffle member; and a cover disposed adjacent the second baffle member on the opposite side of the section of porous material. The first venting holes are laterally spaced from the second venting holes by a predetermined distance such that ionized gases produced by the arcing event passing through one of the first venting holes must travel at minimum the predetermined distance generally along the section of porous material before passing through one of the second venting holes.

18 Claims, 5 Drawing Sheets

(56) References Cited

U.S. PATENT DOCUMENTS 7,674,996 B2 3/2010 Shea et al.
7,705,263 B2 * 4/2010 Rane et al. ..... 218/149
2003/0062341 A1 4/2003 Bach et al.
2008/0067143 A1 3/2008 Broeke et al.
2009/0321181 A1 * 12/2009 Ballard, III ..... 181/264

* cited by examiner

ARC BAFFLING DEVICE

BACKGROUND

1. Field

The disclosed concept pertains generally to electrical switching apparatus and, more particularly, to arc baffling devices for use in such switching apparatus.

2. Background Information

Electrical switching apparatus, such as circuit breakers, provide protection for electrical systems from electrical fault conditions such as, for example, current overloads, short circuits, and abnormal level voltage conditions.

Circuit breakers, for example, typically include a set of stationary electrical contacts and a set of movable electrical contacts. The stationary and movable electrical contacts are in physical and electrical contact with one another when it is desired that the circuit breaker energize a power circuit. When it is desired to interrupt the power circuit, the movable contacts and stationary contacts are separated. Upon initial separation of the movable contacts away from the stationary contacts, an electrical arc is formed in the space between the contacts. The arc provides a means for smoothly transitioning from a closed circuit to an open circuit, but produces a number of challenges to the circuit breaker designer. Among such challenges is the fact that the arc results in the undesirable flow of electrical current through the circuit breaker to the load. Additionally, the arc, which extends between the contacts, often results in vaporization or sublimation of the contact material itself. Therefore, it is desirable to dissipate and extinguish any such arcs as soon as possible upon their propagation.

To facilitate this process, circuit breakers typically include arc chute assemblies which are structured to attract and break-up the arcs. Specifically, the movable contacts of the circuit breaker are mounted on arms that are contained in a pivoting assembly which pivots the movable contacts past or through arc chutes as they move into and out of electrical contact with the stationary contacts. Each arc chute includes a plurality of spaced apart arc plates mounted in a wrapper. In operation, as the movable contact is moved away from the stationary contact, the movable contact moves past the ends of the arc plates, with the arc being magnetically drawn toward and between the arc plates. The arc plates are electrically insulated from one another such that the arc is broken-up and extinguished by the arc plates. Examples of arc chutes are disclosed in U.S. Pat. Nos. 7,034,242; 6,703,576; and 6,297,465.

Additionally, along with the generation of the arc itself, ionized gases, which can cause excessive heat and additional arcing and, therefore, are harmful to electrical components, are formed as a byproduct of the arcing event. The ionized gases produced during an arcing event can undesirably strike to the ground and create ground fault issues. Additionally, debris, such as, for example, molten metal particles or plasma, may be created during the arcing event and thus may be readily transported by the ionized gases. The uncontrolled release of such ionized gases and molten particles can be extremely harmful to components and/or personnel positioned nearby the circuit breaker during an arcing event.

There is a need, therefore, to provide mechanisms which control and defuse the ionized gases and plasma before leaving the housing of the circuit breaker.

Accordingly, there is room for improvement in arc baffles for arc chute assemblies, and in arc chute assemblies for electrical switching apparatus, such as circuit breakers.

SUMMARY

These needs and others are met by embodiments of the disclosed concept, which provides for controlling and cooling of the ionized plasma as it exits an arc chute.

In accordance with one aspect of the disclosed concept, an arc baffle comprises: a first baffle member having a number of first venting holes disposed therein, each of the first venting holes being structured to receive ionized gases produced by an arcing event; a second baffle member having a number of second venting holes disposed therein; a section of porous material disposed between the first baffle member and the second baffle member; and a cover disposed adjacent the second baffle member on the opposite side of the section of porous material, the cover having a number of openings disposed adjacent the second venting holes. The first venting holes are laterally spaced from the second venting holes by a predetermined distance such that ionized gases produced by the arcing event passing through one of the first venting holes must travel at minimum the predetermined distance generally along the section of porous material before passing through one of the second venting holes.

The number of first venting holes may be disposed offset from a centerline of the first baffle member toward a first end thereof and the number of second venting holes may be disposed offset from a centerline of the second baffle member toward a second end thereof.

Each of the first baffle member and the second baffle member may be of generally planar shape.

The section of porous material may comprises a plurality of generally planar mesh screens.

The plurality of generally planar mesh screens may be disposed generally parallel with respect to, and between, the first baffle member and the second baffle member.

Each of the mesh screens may be formed from steel and glass reinforced polyester.

The cover may include a cavity portion disposed on an underside thereof adjacent the number of openings and the second baffle member and the section of porous material may be housed within the cavity portion.

The first baffle member may be coupled to the cover via a number of fasteners.

The cover may further include a number of tabs structured to engage corresponding apertures formed in portions of an arc chute.

In accordance with another aspect of the disclosed concept, an arc chute comprises: a first sidewall; a second sidewall; a plurality of electrically conductive arc plates disposed between, and supported by the first sidewall and the second sidewall, the plurality of electrically conductive arc plates being structured to attract an arc produced by an arcing event resulting from the separation of electrical contacts disposed adjacent thereto; and an arc baffle disposed adjacent the plurality of electrically conductive arc plates. The arc baffle comprises: a first baffle member having a number of first venting holes disposed therein, each of the first venting holes being structured to receive ionized gases produced by the arcing event; a second baffle member having a number of second venting holes disposed therein; a section of porous material disposed between the first baffle member and the second baffle member; and a cover disposed adjacent the second baffle member on the opposite side of the section of porous material, the cover having a number of openings disposed adjacent the second venting holes. The first venting holes are laterally spaced from the second venting holes by a predetermined distance such that ionized gases produced by the arcing event passing through one of the first venting holes must travel at minimum the predetermined distance generally along the section of porous material before passing through one of the second venting holes.

The cover may further include a number of tabs extending from opposing sides thereof, the first sidewall may include a first aperture, the second sidewall may include a second aperture, and the cover may be coupled to the first sidewall and the second sidewall via engagement of the tabs with the first and second apertures.

The number of first venting holes may be disposed offset from a centerline of the first baffle member toward a first end thereof and the number of second venting holes may be disposed offset from a centerline of the second baffle member toward a second end thereof.

Each of the first baffle member and the second baffle member may be of generally planar shape.

The section of porous material may comprise a plurality of generally planar mesh screens.

The plurality of generally planar mesh screens may be disposed generally parallel with respect to, and between, the first baffle member and the second baffle member.

The cover may include a cavity portion disposed on an underside thereof adjacent the number of openings, and the second baffle member and the section of porous material may be housed within the cavity portion.

The first baffle member may be coupled to the cover via a number of fasteners.

In accordance with yet another aspect of the disclosed concept, an electrical switching apparatus comprises: separable electrical contacts disposed within a housing and an arc chute disposed adjacent the separable electrical contacts. The arc chute comprises: a first sidewall; a second sidewall; a plurality of electrically conductive arc plates disposed between, and supported by the first sidewall and the second sidewall, the plurality of electrically conductive arc plates being structured to attract an arc produced by an arcing event resulting from the separation of the electrical contacts disposed adjacent thereto; and an arc baffle disposed adjacent the plurality of electrically conductive arc plates. The arc baffle comprises: a first baffle member having a number of first venting holes disposed therein, each of the first venting holes being structured to receive ionized gases produced by the arcing event; a second baffle member having a number of second venting holes disposed therein; a section of porous material disposed between the first baffle member and the second baffle member; and a cover disposed adjacent the second baffle member on the opposite side of the section of porous material, the cover having a number of openings disposed adjacent the second venting holes. The first venting holes are laterally spaced from the second venting holes by a predetermined distance such that ionized gases produced by the arcing event passing through one of the first venting holes must travel at minimum the predetermined distance generally along the section of porous material before passing through one of the second venting holes.

The cover may further include a number of tabs extending from opposing sides thereof, the first sidewall may include a first aperture, the second sidewall may include a second aperture, and the cover may be coupled to the first sidewall and the second sidewall via engagement of the tabs with the first and second apertures.

The cover may further include an opening and the arc baffle may be coupled to the housing via a fastener disposed in the opening.

Each of the first baffle member and the second baffle member may be of generally planar shape and the section of porous material may comprise a plurality of generally planar mesh screens disposed generally parallel with respect to, and between, the first baffle member and the second baffle member.

The cover may include a cavity portion disposed on an underside thereof adjacent the number of openings, the second baffle member and the section of porous material may be housed within the cavity portion, and the first baffle member may be coupled to the cover via a number of fasteners.

These and other objects, features, and characteristics of the disclosed concept, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosed concept.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
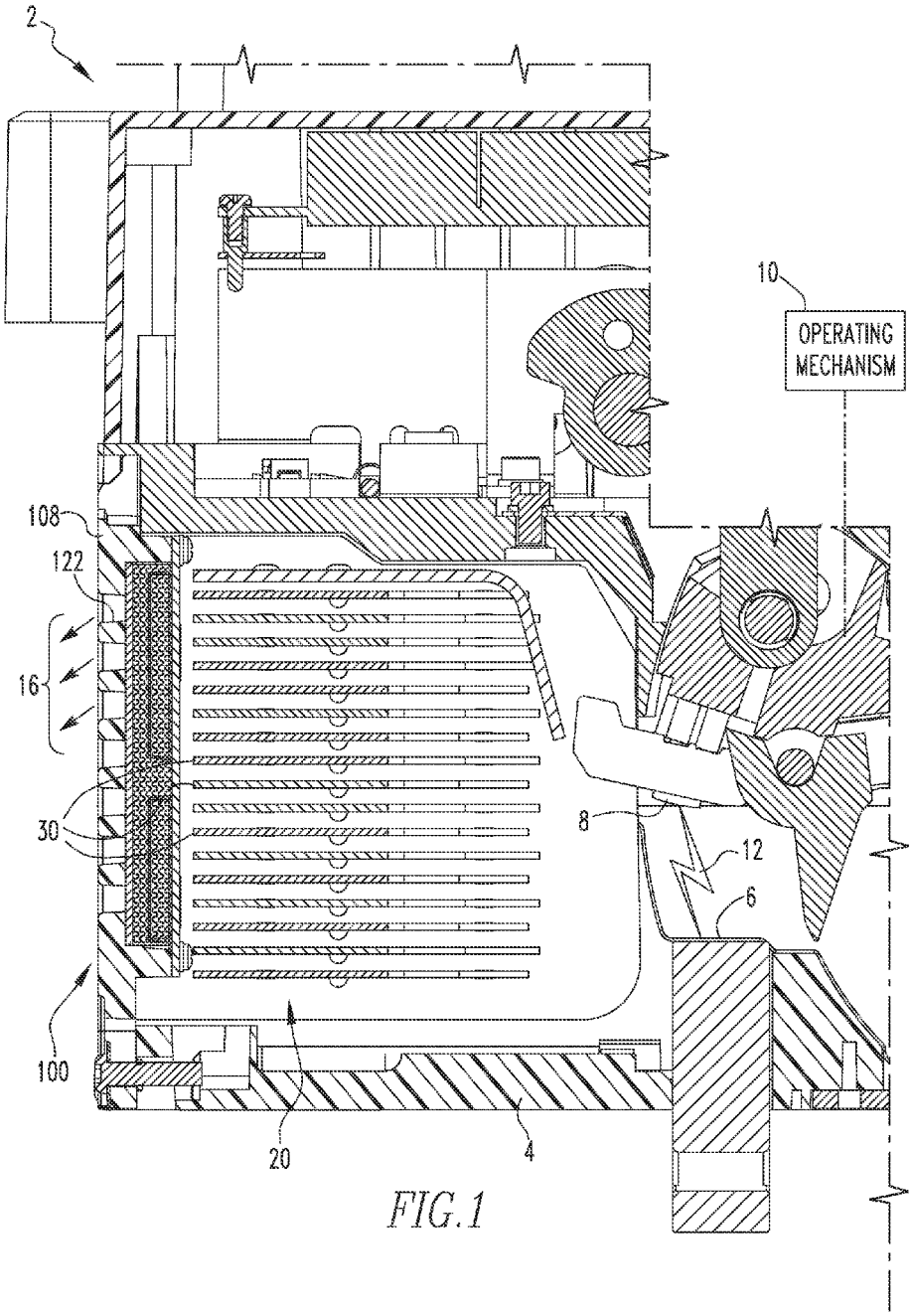
FIG. 1 is a cross-sectional view of a portion of a circuit breaker, including an arc chute assembly having an arc baffle in accordance with an embodiment of the disclosed concept.

For purposes of illustration, embodiments of the disclosed concept will be described as applied to arc chute assemblies for molded case circuit breakers, although it will become apparent that they could also be applied to a wide variety of electrical switching apparatus (e.g., without limitation, circuit switching devices and other circuit interrupters, such as contactors, motor starters, motor controllers and other load controllers) having an arc chute.

Directional phrases used herein, such as, for example, left, right, top, bottom, front, back and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "ionized" means completely or partially converted into ions and being at least somewhat electrically conductive such as, for example, ionized gases generated by arcing between separable electrical contacts of a circuit breaker when opened.

As employed herein, the term "number" shall mean one or an integer greater than one (i.e., a plurality).

As employed herein, the term "fastener" refers to any suitable connecting or tightening mechanism expressly including, but not limited to, screws, bolts, nuts (e.g., without limitation, lock nuts) and combinations thereof.

As employed herein, the term "laterally spaced" means separated by a distance toward a side of the object. In instances where two objects lying in different generally parallel planes are said to be "laterally spaced", such spacing shall refer to the distance between such objects if superimposed on a single plane.

FIG. 1 shows a portion of an electrical switching apparatus, such as a circuit breaker 2, including a housing 4, separable contacts 6,8 (e.g., stationary contact 6 and movable contact 8), enclosed by the housing 4, and an operating mechanism 10 (shown in simplified form in FIG. 1) structured to open and close the separable contacts 6,8. Specifically, the operating mechanism 10 is structured to trip open the separable contacts 6,8 in response to an electrical fault (e.g., without limitation, an overcurrent condition, an overload condition, an undervoltage condition, or a relatively high level short circuit or fault condition). When the separable contacts 6,8 trip open, an arc 12 is generated. The circuit breaker 2 includes at least one arc chute assembly 20 disposed at or about the separable contacts 6,8 in order to attract and dissipate the arc 12.

Figure 2:
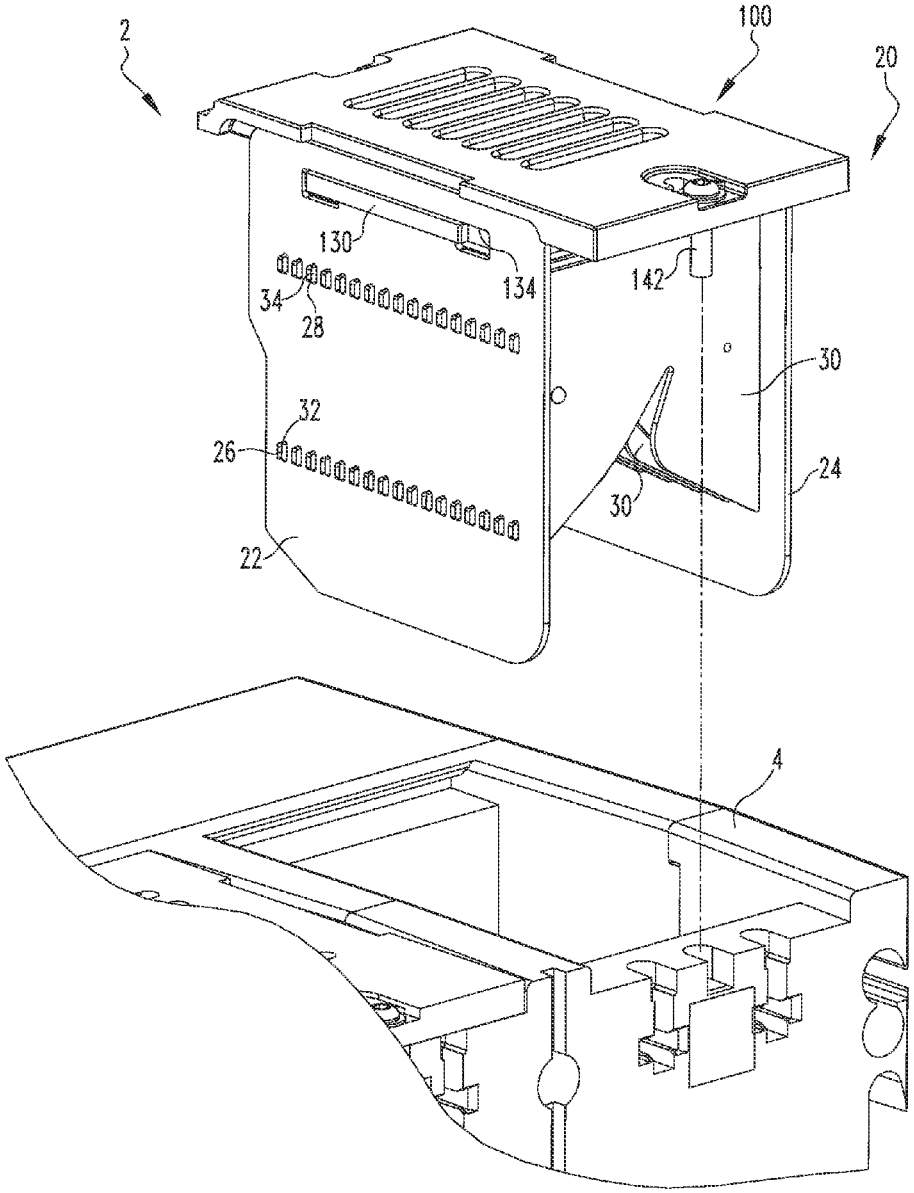
FIG. 2 is an isometric view of a portion of the circuit breaker of FIG. 1 with the arc chute assembly shown exploded from the circuit breaker.

Referring to FIG. 2 in addition to FIG. 1, each arc chute assembly 20 includes first and second opposing sidewalls 22,24 (e.g., made of a suitable non-conductive composite material) and a plurality of electrically conductive arc plates 30 (only two are labeled in FIG. 2) (e.g., without limitation, nickel plated; 1010 magnetic steel plates) disposed between, and supported by the first and second opposing sidewalls 22,24. More specifically, each of the first and second opposing sidewalls 22,24 of the arc chute assembly 20 includes a plurality of apertures 26,28 (shown only on first opposing sidewall 22 of FIG. 2), and each arc plate 30 includes a number of protrusions 32,34 (shown only in first opposing sidewall 22 of arc chute assembly 20 of FIG. 2) extending outward therefrom. The apertures 26,28 of the first and second opposing sidewalls 22,24 each receive the protrusions 32,34 of a corresponding one of the arc plates 30. It is to be appreciated that arc plates 30 are structured to generally attract an arc produced by separation of contacts 6 and 8 through any known means and that the general structure of the arc plates 30 and sidewalls 22,24 of arc chute assembly 20 is provided for example purposes only and is not intended to be limiting upon the disclosed concept. Instead, it is to be appreciated that embodiments of the disclosed concept may be generally employed with arc chute assemblies of various constructions. U.S. Pat. Nos. 7,034,242 and 7,674,996, for example, without limitation, provide non-limiting examples of arc chute assemblies generally suitable for use in accordance with embodiments of the disclosed concept.

In order to control and defuse ionized gases created by an arcing event before exiting housing 4 of the circuit breaker 2, arc chute assembly 20 further includes an arc baffle 100 for defusing and selectively discharging ionized gasses (generally indicated by the arrows 16 in FIGS. 1 and 7) from the housing 4 produced as a byproduct of the arc 12 (FIG. 1). Referring to FIGS. 3-6, arc baffle 100 includes a first baffle member 102, a second baffle member 104, a section of porous material 106 disposed between the first baffle member and the second baffle member 104, and a cover 108. In the illustrated example embodiment, the first arc baffling member 102 and the second arc baffle member 104 are comprised of machined arc and track resistant insulating reinforced thermoset polyester, however other suitable materials may be employed without varying from the scope of the disclosed concept.

Figure 5:
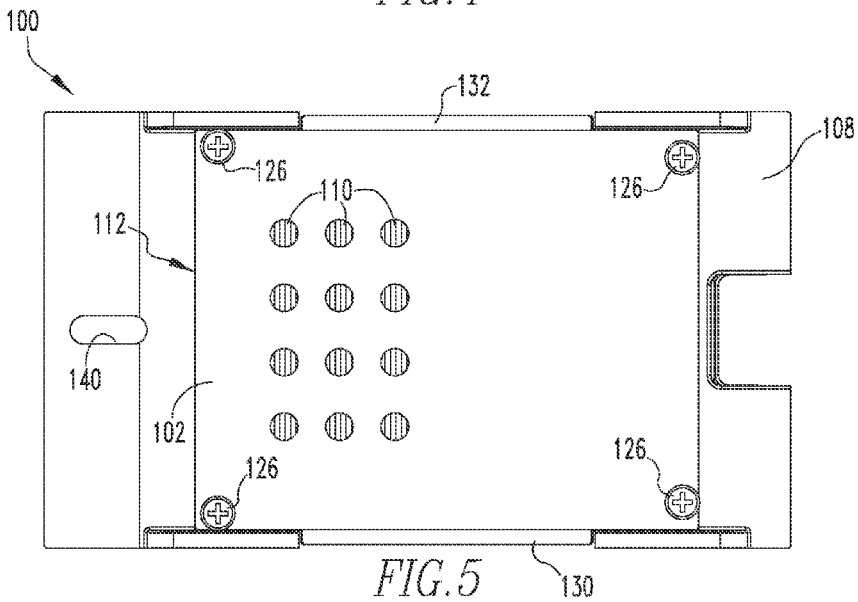
Figure 6:
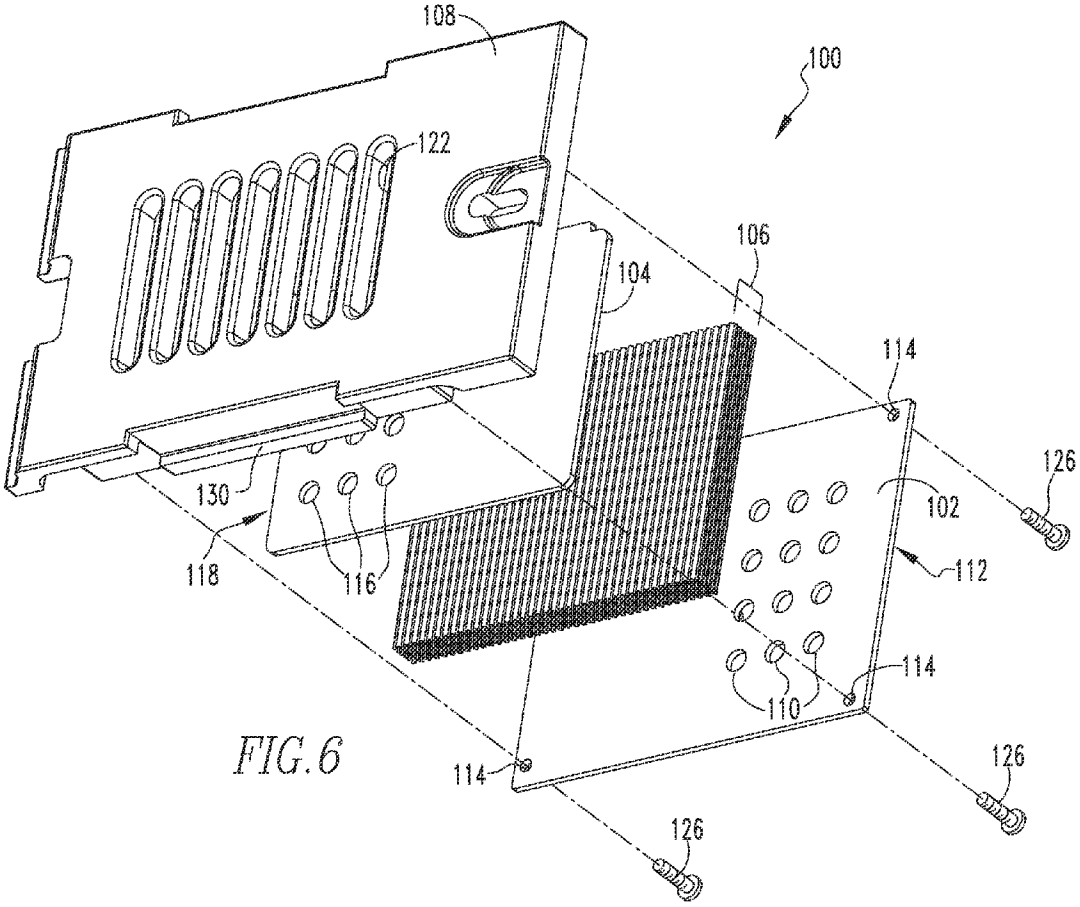
FIG. 6 is an exploded isometric view of the arc baffle of FIGS. 1-5.
Figure 7:
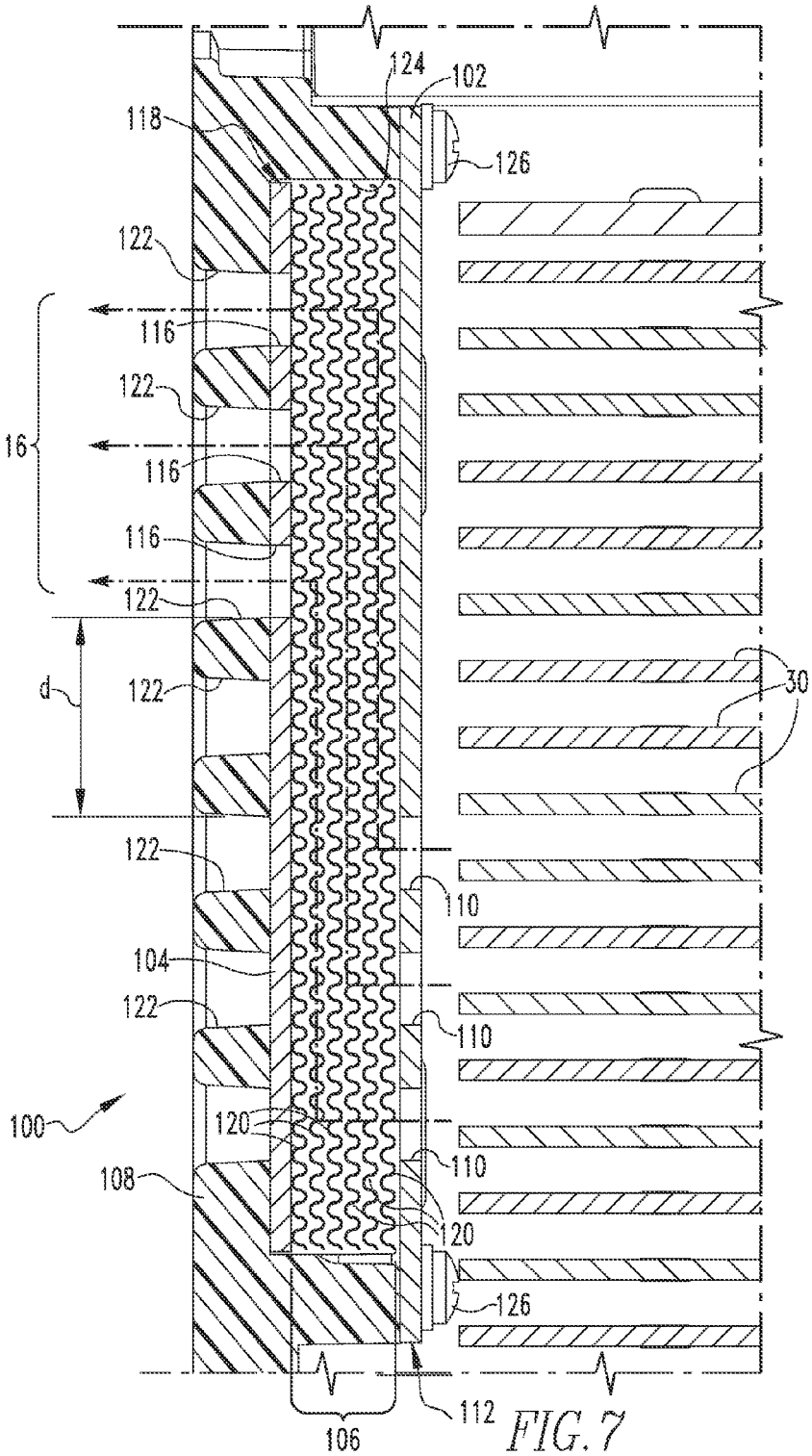
FIG. 7 is a detailed cross-sectional view of a portion of the circuit breaker of FIG. 1 taken along another section of the circuit breaker showing details of the arc baffle and flow of ionized gases relative thereto.

Referring to FIGS. 5-7, first baffle member 102 is of generally planar shape and includes a number of first venting holes 110 (three are labeled in FIGS. 5 and 6) disposed therein in a first grouping offset from a centerline (not numbered) of the first baffle member 102 toward a first end 112 thereof. Although twelve first venting holes 110 of circular shape are illustrated (arranged in three rows of four), it is to be appreciated that one or more of the quantity, size, or arrangement of the first venting holes may be varied (as long as such venting holes are generally disposed toward first end 112) without varying from the scope of the disclosed concept. As shown in FIG. 6, first baffle member 102 further includes a number of mounting apertures 114 for coupling first baffle member 102 to cover 108, as discussed in greater detail below.

Figure 3:
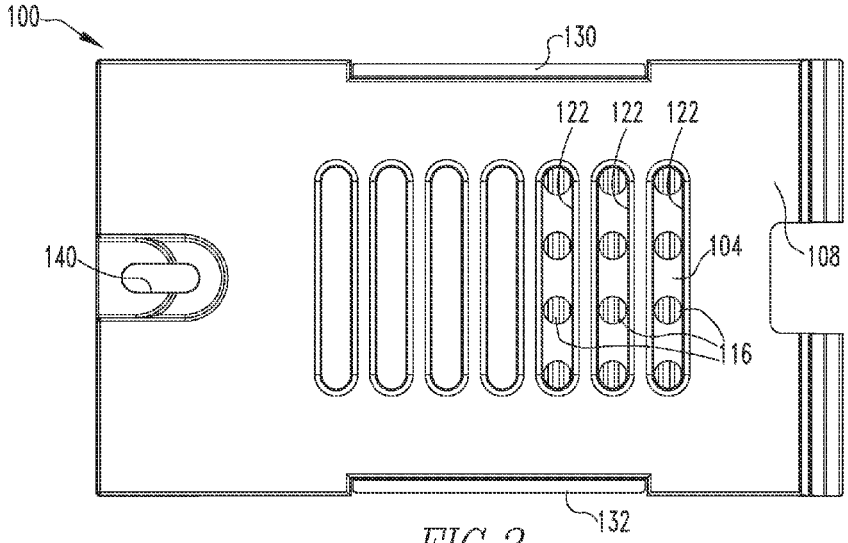
FIGS. 3, 4 and 5, respectively, are top, side and bottom views of the arc baffle of FIGS. 1 and 2.
Figure 4:
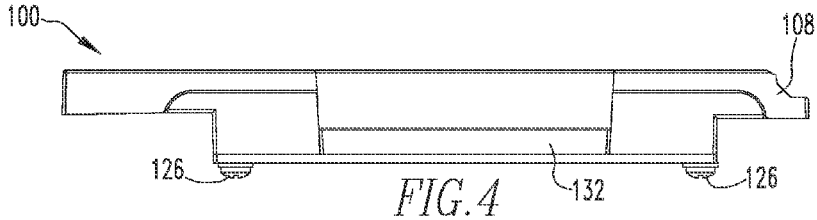

Referring to FIGS. 3, 6 and 7, second baffle member 104 is also of generally planar shape and includes a number of second venting holes 116 (three are labeled in FIGS. 3 and 6) disposed therein in a second grouping offset from a centerline (not numbered) of the second baffle member 104 toward a second end 118 (FIGS. 6 and 7) thereof. Although twelve second venting holes 116 of circular shape are illustrated (arranged in three rows of four), it is to be appreciated that one or more of the quantity, size, or arrangement of the second venting holes may be varied (as long as such venting holes are generally disposed toward second end 118) without varying from the scope of the disclosed concept.

Referring to FIGS. 6 and 7, the section of porous material 106 is formed from a number of generally planar mesh screens 120 (e.g., without limitation, formed from steel woven cloth or other suitable material) stacked together to a predetermined thickness (not labeled). The thickness of the section of porous material may be selectively varied in order to accommodate with voltage and current rating of the circuit associated therewith. As best shown in the sectional view of FIG. 7, in the particular example embodiment illustrated in the FIGS., six layers of individual mesh screens 120 formed from steel woven cloth are employed in order to meet the requirements for the particular application. Such steel cloth may be plated or stainless.

Cover 108 may be formed via a molding process (e.g., without limitation, made of a suitable insulating material, such as, for example, glass filled polyester). Referring to FIGS. 3, 6 and 7, cover 108 includes a number of openings 122 (seven are shown in the example illustrated embodiment) which may be of slotted or of other suitable shape or shapes through which gases (such as shown by arrows 16 in FIGS. 1 and 7) produced by an arcing event may be vented, as discussed further below. Cover 108 further includes a cavity portion 124 (FIG. 7) disposed on an underside (not numbered) thereof adjacent the plurality of openings 122. As shown in the detailed sectional view of FIG. 7, cavity portion 124 is generally sized and adapted to house the second baffle member 104 as well as the section of porous material 106 therein. The second baffle member 104 and the section of porous material 106 are constrained in the cavity portion 124 by the first baffle member 102 which is coupled to the cover 108 via a number of fasteners 126 which engage the first baffle member 102 about each of the mounting apertures 114.

Continuing to refer to FIG. 7, when assembled as arc baffle 100, the first and second baffle members 102 and 104 are arranged such that the grouping of first venting holes 110 of the first baffle member 102 are laterally spaced from the grouping of second venting holes 116 of the second baffle member 104 by a predetermined distance d based on the particular application, thus forcing any ionized gases 16 produced by an arcing event within the circuit breaker to travel at minimum the predetermined distance d generally along the section of porous material 106 before exiting the circuit breaker through one of openings 122 in cover 108. As the ionized gases 16 pass through the porous material 106 they are effectively diffused by providing a longer path and cooling of the ionized plasma, and any debris, such as, for example, molten metal particles or plasma, contained therein is also effectively trapped before exiting through any of openings 122 of cover 108.

As shown in FIG. 2, the arc baffle 100 is coupled in the arc chute 20 to the plurality of arc plates 30 via tabs 130,132 which extend from opposing sides of cover 108 and engage the first and second opposing sidewalls 22,24 of arc chute assembly 20 at respective openings in each of sidewalls 22,24 (only the opening 134 of sidewall 22 is shown in FIG. 2). As shown in FIGS. 1 and 7, through such coupling the first baffle member 102 is structured to be disposed at or about the ends (not numbered) of arc plates 30 opposite from the ends disposed near the fixed and movable contacts 6, 8. As shown in FIGS. 2, 3 and 5, cover 108 may further include one or more openings 140 which cooperatively receive a fastener 142 (FIG. 2) to retain the arc chute assembly 20 to a circuit breaker housing (e.g., 4 of FIGS. 1 and 2).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An arc baffle comprising:

a first baffle member having a number of first venting holes disposed therein near a first end thereof and the remainder of the first baffle member being free of any vent holes, each of the first venting holes being structured to receive ionized gases produced by an arcing event;

a second baffle member having a number of second venting holes disposed therein near a second end thereof and the remainder of the second baffle member being free of any vent holes;

a section of porous material disposed between the first baffle member and the second baffle member; and a cover disposed adjacent the second baffle member on the opposite side of the section of porous material, the cover having a number of openings disposed adjacent the second venting holes, wherein the number of first venting holes are disposed offset from a centerline of the arc baffle toward a first end of the arc baffle, and wherein the number of second venting holes are disposed offset from the centerline of the arc baffle toward a second end of the arc baffle opposite from the first end such that the number of second venting holes are laterally spaced from the number of first venting holes by at least a predetermined distance, whereby ionized gases produced by the arcing event passing through the first baffle member and the second baffle member enter one of the first venting holes and then must travel at minimum the predetermined distance generally along the section of porous material and across the centerline of the arc baffle before passing through one of the second venting holes.

2. The arc baffle of claim 1 wherein each of the first baffle member and the second baffle member are of generally planar shape.

3. The arc baffle of claim 1 wherein the section of porous material comprises a plurality of generally planar mesh screens.

4. The arc baffle of claim 3 wherein the plurality of generally planar mesh screens are disposed generally parallel with respect to, and between, the first baffle member and the second baffle member.

5. The arc baffle of claim 4 wherein each of the mesh screens is formed from steel and glass reinforced polyester.

6. The arc baffle of claim 1 wherein the cover includes a cavity portion disposed on an underside thereof adjacent the number of openings, wherein the second baffle member and the section of porous material are housed within the cavity portion, and wherein the first baffle member is coupled to the cover via a number of fasteners.

7. The arc baffle of claim 6 wherein the cover further includes a number of tabs structured to engage corresponding apertures formed in portions of an arc chute.

8. An arc chute comprising:

a first sidewall;

a second sidewall;

a plurality of electrically conductive arc plates disposed between, and supported by the first sidewall and the second sidewall, the plurality of electrically conductive arc plates being structured to attract an arc produced by an arcing event resulting from the separation of electrical contacts disposed adjacent thereto; and an arc baffle disposed adjacent the plurality of electrically conductive arc plates, the arc baffle comprising:

a first baffle member having a number of first venting holes disposed therein near a first end thereof and the remainder of the first baffle member being free of any vent holes, each of the first venting holes being structured to receive ionized gases produced by the arcing event;

a second baffle member having a number of second venting holes disposed therein near a second end thereof and the remainder of the second baffle member being free of any vent holes;

a section of porous material disposed between the first baffle member and the second baffle member; and a cover disposed adjacent the second baffle member on the opposite side of the section of porous material, the cover having a number of openings disposed adjacent the second venting holes, wherein the number of first venting holes are disposed offset from a centerline of the arc baffle toward a first end of the arc baffle, and wherein the number of second venting holes are disposed offset from the centerline of the arc baffle toward a second end of the arc baffle opposite from the first end such that the number of second venting holes are laterally spaced from the number of first venting holes by at least a predetermined distance, whereby ionized gases produced by the arcing event passing through the first baffle member and the second baffle member enter one of the first venting holes and then must travel at minimum the predetermined distance generally along the section of porous material and across the centerline of the arc baffle before passing through one of the second venting holes.

9. The arc chute assembly of claim 8 wherein the cover further includes a number of tabs extending from opposing sides thereof, wherein the first sidewall includes a first aperture, wherein the second sidewall includes a second aperture, and wherein the cover is coupled to the first sidewall and the second sidewall via engagement of the tabs with the first and second apertures.

10. The arc chute assembly of claim 8 wherein each of the first baffle member and the second baffle member are of generally planar shape.

11. The arc chute assembly of claim 8 wherein the section of porous material comprises a plurality of generally planar mesh screens.

12. The arc chute assembly of claim 8 wherein the plurality of generally planar mesh screens are disposed generally parallel with respect to, and between, the first baffle member and the second baffle member.

13. The arc chute assembly of claim 8 wherein the cover includes a cavity portion disposed on an underside thereof adjacent the number of openings, wherein the second baffle member and the section of porous material are housed within the cavity portion, and wherein the first baffle member is coupled to the cover via a number of fasteners.

14. An electrical switching apparatus comprising:

separable electrical contacts disposed within a housing; and an arc chute disposed adjacent the separable electrical contacts, the arc chute comprising:

a first sidewall;

a second sidewall;

a plurality of electrically conductive arc plates disposed between, and supported by the first sidewall and the second sidewall, the plurality of electrically conductive arc plates being structured to attract an arc produced by an arcing event resulting from the separation of the electrical contacts disposed adjacent thereto; and an arc baffle disposed adjacent the plurality of electrically conductive arc plates, the arc baffle comprising:

a first baffle member having a number of first venting holes disposed therein near a first end thereof and the remainder of the first baffle member being free of any vent holes, each of the first venting holes being structured to receive ionized gases produced by the arcing event;

a second baffle member having a number of second venting holes disposed therein near a second end thereof and the remainder of the second baffle member being free of any vent holes;

a section of porous material disposed between the first baffle member and the second baffle member; and a cover disposed adjacent the second baffle member on the opposite side of the section of porous material, the cover having a number of openings disposed adjacent the second venting holes, wherein the number of first venting holes are disposed offset from a centerline of the arc baffle toward a first end of the arc baffle, and wherein the number of second venting holes are disposed offset from the centerline of the arc baffle toward a second end of the arc baffle opposite from the first end such that the number of second venting holes are laterally spaced from the number of first venting holes by at least a predetermined distance, whereby ionized gases produced by the arcing event passing through the first baffle member and the second baffle member enter one of the first venting holes and then must travel at minimum the predetermined distance generally along the section of porous material and across the centerline of the arc baffle before passing through one of the second venting holes.

15. The electrical switching apparatus of claim 14 wherein the cover further includes a number of tabs extending from opposing sides thereof, wherein the first sidewall includes a first aperture, wherein the second sidewall includes a second aperture, and wherein the cover is coupled to the first sidewall and the second sidewall via engagement of the tabs with the first and second apertures.

16. The electrical switching apparatus of claim 15 wherein the cover further includes an opening and wherein the arc baffle is coupled to the housing via a fastener disposed in the opening.

17. The electrical switching apparatus of claim 15 wherein each of the first baffle member and the second baffle member are of generally planar shape and wherein the section of porous material comprises a plurality of generally planar mesh screens disposed generally parallel with respect to, and between, the first baffle member and the second baffle member.

18. The electrical switching apparatus of claim 17 wherein the cover includes a cavity portion disposed on an underside thereof adjacent the number of openings, wherein the second baffle member and the section of porous material are housed within the cavity portion, and wherein the first baffle member is coupled to the cover via a number of fasteners.

* * * * *